US005724630A

United States Patent [19]

Mashiba

[11] Patent Number: 5,724,630

[45] Date of Patent: Mar. 3, 1998

[54] IMAGE FORMING APPARATUS WITH STANDBY TEMPERATURE CONTROL OF THERMAL FIXING

[75] Inventor: Tamaki Mashiba, Nara, Japan

[73] Assignee: Sharp Kabushiki Kaisha, Osaka, Japan

[21] Appl. No.: 611,427

[22] Filed: Mar. 6, 1996

[30] Foreign Application Priority Data

Mar. 6, 1995 [JP] Japan ..... 7-045347

[51] Int. Cl.[6] ..... G03G 15/20

[52] U.S. Cl. ..... 399/70; 399/69; 399/335

[58] Field of Search ..... 355/203, 204, 355/208, 282, 285, 289; 399/70, 33, 94, 320, 328, 330, 335, 67, 69

[56] References Cited

U.S. PATENT DOCUMENTS

| | | |
|---|---|---|
| 5,109,255 | 4/1992 | Nishikawa et al. . |
| 5,241,349 | 8/1993 | Nagasaka . |
| 5,321,478 | 6/1994 | Nakamura et al. . |
| 5,489,935 | 2/1996 | Dornier . |
| 5,502,546 | 3/1996 | Muto . |
| 5,528,346 | 6/1996 | Kim et al. . |

FOREIGN PATENT DOCUMENTS

| | | |
|---|---|---|
| 5-30315 | 2/1993 | Japan . |
| 5-47833 | 7/1993 | Japan . |
| 7-129022 | 5/1995 | Japan . |

OTHER PUBLICATIONS

*Patent Abstracts of Japan*, vol. 95, No. 8, Sep. 29, 1995 and JP–A–07 129022 (Fuji Xerox Co Ltr), May 19, 1995 with English Abstract.

*Patent Abstracts of Japan*, vol. 017, No. 317 (E–1382), Jun. 16, 1993 and JP–A–05 030315 (Canon Inc), Feb. 5, 1993 with English Abstract.

Comments regarding the Abstract of the invention of the present application and the Abstracts of references BA, BB and BC.

*Primary Examiner*—Sandra L. Brase

*Attorney, Agent, or Firm*—David G. Conlin; Brian L. Michaelis

[57] ABSTRACT

An image-forming apparatus which controls the temperature of the contained thermal fixing device on standby, based on the image formation history information on times of past image formations, etc., to efficiently reduce the power consumption during standby without lowering the availability factor of the image-forming apparatus, which is constructed so that the data on use frequency, including the current time, the number of copies made, etc., (image formation history information) is stored each time an image-forming process is executed, the control section sums the image formation history information on an hourly or other basis, and the temperature of the thermal fixing device on standby is controlled based on the current time-related image formation history information summed on an hourly basis.

7 Claims, 17 Drawing Sheets

FIG. 5

| I | MI | DI | WI | tI |
|---|---|---|---|---|
| 1 | 3 | 95-01-23 | THU | 09:15 |
| 2 | 5 | 95-01-23 | THU | 09:20 |
| 3 | 1 | 95-01-23 | THU | 09:35 |
| 4 | 10 | 95-01-23 | THU | 09:50 |
| 5 | 4 | 95-01-23 | THU | 10:03 |
| 6 | 3 | 95-01-23 | THU | 10:10 |
| | | | | |

FIG. 9

| TEMP. OF FIXING DEVICE (℃) | POWER CONSUMPTION OF FIXING DEVICE (Wh) | WAITING TIME (SEC.) |
|---|---|---|
| 180 | 100 | 0 |
| 160 | 80 | 5 |
| 140 | 60 | 10 |
| 120 | 40 | 15 |
| HEATER OFF | 0 | 40 |

| MODE | FREQUENCY Y | | TEMP. GRADIENT θ |
|---|---|---|---|
| 1 | 7 OR MORE/HR. | θ1 | −5℃/MIN. |
| 2 | 5~6/HR. | θ2 | −10℃/MIN. |
| 3 | 4 OR LESS/HR. | θ3 | −20℃/MIN. |

| MODE | FIXING TEMP. (℃) | POWER CONSUMED FOR 2 MIN. AFTER COPYING | RECOPYING-WAIT TIME |
|---|---|---|---|
| 1 | 170 | 95 | 2.5 |
| 2 | 160 | 90 | 5 |
| 3 | 140 | 80 | 10 |

| MODE | FREQUENCY Y | TEMP. SET FOR STANDBY | POWER CONSUMPTION DURING STANDBY | WAITING TIME |
|---|---|---|---|---|
| 1 | 7 OR MORE/HR. | 180℃ | 100WH | 0 SEC. |
| 2 | 5~6/HR. | 160℃ | 80WH | 5 SEC. |
| 3 | 3~4/HR. | 140℃ | 60WH | 10 SEC. |
| 4 | 1~2/HR. | 120℃ | 40WH | 15 SEC. |
| 5 | 0/HR. | HEATER OFF | 0WH | 40 SEC. |

| MODE | FREQUENCY Y | TIME ELAPSED UNTIL SETTING TO 120℃ AFTER COPYING | POWER CONSUMPTION DURING STANDBY | WAITING TIME |
|---|---|---|---|---|
| 1 | 7 OR MORE/HR. | 12 MIN. | 100WH/40WH | 10 SEC./15 SEC. |
| 2 | 5~6/HR. | 8 MIN. | 100WH/40WH | 10 SEC./15 SEC. |
| 3 | 3~4/HR. | 4 MIN. | 100WH/40WH | 10 SEC./15 SEC. |
| 4 | 2 OR LESS/HR. | 0 MIN. | 100WH/40WH | 10 SEC./15 SEC. |

| MODE | FREQUENCY Y | TIME ELAPSED UNTIL TEMP. CONTROL STARTS DURING STANDBY | TEMP. GRADIENT θ |
|---|---|---|---|
| 1 | 7 OR MORE/HR. | 12 MIN. | −5℃/MIN. |
| 2 | 5~6/HR. | 8 MIN. | −10℃/MIN. |
| 3 | 3~4/HR. | 4 MIN. | −20℃/MIN. |
| 4 | 2 OR LESS/HR. | 0 MIN. | SET TO 120℃ IMMEDIATELY |

| MODE | FREQUENCY Y | TEMP. SET FOR STANDBY | TEMP. GRADIENT |
|---|---|---|---|
| 1 | 7 OR MORE/HR. | 180℃ | 0℃/MIN. |
| 2 | 5~6/HR. | 160℃ | −10℃/MIN. |
| 3 | 3~4/HR. | 140℃ | −20℃/MIN. |
| 4 | 2 OR LESS/HR. | 120℃ | SET TO 120℃ IMMEDIATELY |

| MODE | FREQUENCY Y | TEMP. SET FOR STANDBY | TIME ELAPSED UNTIL TEMP. CONTROL STARTS DURING STANDBY |
|---|---|---|---|
| 1 | 7 OR MORE/HR. | 180℃ | |
| 2 | 5~6/HR. | 160℃ | 8 MIN. |
| 3 | 3~4/HR. | 140℃ | 4 MIN. |
| 4 | 2 OR LESS/HR. | 120℃ | 0 MIN. |

IMAGE FORMING APPARATUS WITH STANDBY TEMPERATURE CONTROL OF THERMAL FIXING

BACKGROUND OF THE INVENTION

1. Field of the Invention

The present invention relates to an image-forming apparatus containing a thermal fixing device, such as a copying machine or fax machine, and more particularly to an image-forming apparatus designed to reduce power consumption during standby, without lowering the availability factor.

2. Description of the Related Art

With image-forming apparatuses of the prior art such as copying machines or fax machines, a charged photoconductive drum is exposed to light to form an electrostatic latent image, toner is applied to the electrostatic latent image to make visible the toner image which is then transferred to a sheet, and the toner image transferred to the sheet is thermally fixed by a thermal fixing device. For the thermal fixing, the thermal fixing device is warmed to a prescribed temperature with a heater. This, however, involves the problem of long time needed to warm the thermal fixing device to the prescribed temperature. Most copying machines avoid this problem by energizing the heater at all times including idling periods to maintain the thermal fixing apparatus at or close to a serviceable temperature, but this results in another problem in that much power is consumed even when the machines are not in copying service.

As a solution to this problem, an image-forming apparatus has been proposed which is designed to reduce the power consumption during idling periods. For example, a fax machine has been proposed, where frequent-use periods and infrequent-use periods are determined in advance, and the heater is kept on at all times during frequent-use periods to maintain the thermal fixing device at or close to a serviceable temperature, whereas the heater is kept off to lower the power consumption during infrequent-use periods (Japanese Unexamined Patent Application Disclosure HEI 5-30315). Another type of copying machine has also been proposed which is designed to maintain the thermal fixing device at a temperature lower than the serviceable temperature after it has remained idle over a prescribed period, to lower the power consumption when the machine is not in service (Japanese Examined Patent Application Publication HEI 5-47833).

All these image-forming apparatuses mentioned above, however, are designed to control the temperatures of the thermal fixing devices based on the previously determined time periods or the observed idling periods, but are not designed to control the temperatures of the thermal fixing devices based on use frequencies of the image-forming apparatuses. Accordingly, sometimes the temperatures of the thermal fixing devices are lowered even during frequent-use periods, or conversely the serviceable temperatures are maintained during infrequent-use periods, and this has resulted in lowering the availability factors of the image-forming apparatuses, and has also failed to efficiently lower the power consumption during standby.

SUMMARY OF THE INVENTION

It is an object of the present invention to provide an image-forming apparatus which controls the temperature of the thermal fixing device on standby based on the image formation history information on the number of image formations of the past, etc. to efficiently reduce the power consumption during standby without lowering the availability factor of the image-forming apparatus.

The present invention relates to an image-forming apparatus equipped with a thermal fixing device which transfers a toner image formed on the surface of a photoconductive drum to a sheet, and then fixes the toner image on the sheet, characterized by comprising:

storage means for storing the image formation history information on the number of image forming processes implemented in the past, etc.; and temperature control means for calculating the use frequency based on the image formation history information stored in the storage means to control the temperature of the thermal fixing device on standby based on the calculated use frequency.

The temperature control means is also characterized by comprising means for lowering the temperature of the thermal fixing device by a prescribed temperature with the lapse of standby time; and means for determining the prescribed temperature based on the use frequency.

The temperature control means is also characterized by comprising means for controlling the thermal fixing device on standby to a temperature which is set high when the use frequency is high, and low when the use frequency is low, through calculation.

The temperature control means is also characterized by comprising means for setting through calculation the time during which the temperature of the thermal fixing device on standby is maintained at an image-formable temperature, to a long time for frequent use and to a short time for infrequent use relative to the lapse of the standby time.

The temperature control means is also characterized by comprising means for classifying the image formation history information into the frequency of high-volume processes in which the number of image-formed sheets per process is larger than a prescribed number, and the frequency of low-volume processes in which the number of image-formed sheets per process is smaller than the prescribed number, based on the image formation history information, to calculate the temperature to be set for the thermal fixing device during standby.

The temperature control means is also characterized by comprising summing means for summing data of the image formation history information on a prescribed period basis, and controls the temperature of the thermal fixing device based on the image formation history information for a given period corresponding to the current period of operation.

BRIEF DESCRIPTION OF THE DRAWINGS

Other and further objects, features, and advantages of the invention will be more explicit from the following detailed description taken with reference to the drawings wherein:

FIG. 5 is a table illustrating the copying history information to be stored in a RAM;

FIG. 9 is a table listing the temperature, the waiting time and the power consumption of the thermal fixing device;

DETAILED DESCRIPTION OF THE INVENTION

Figure 1:
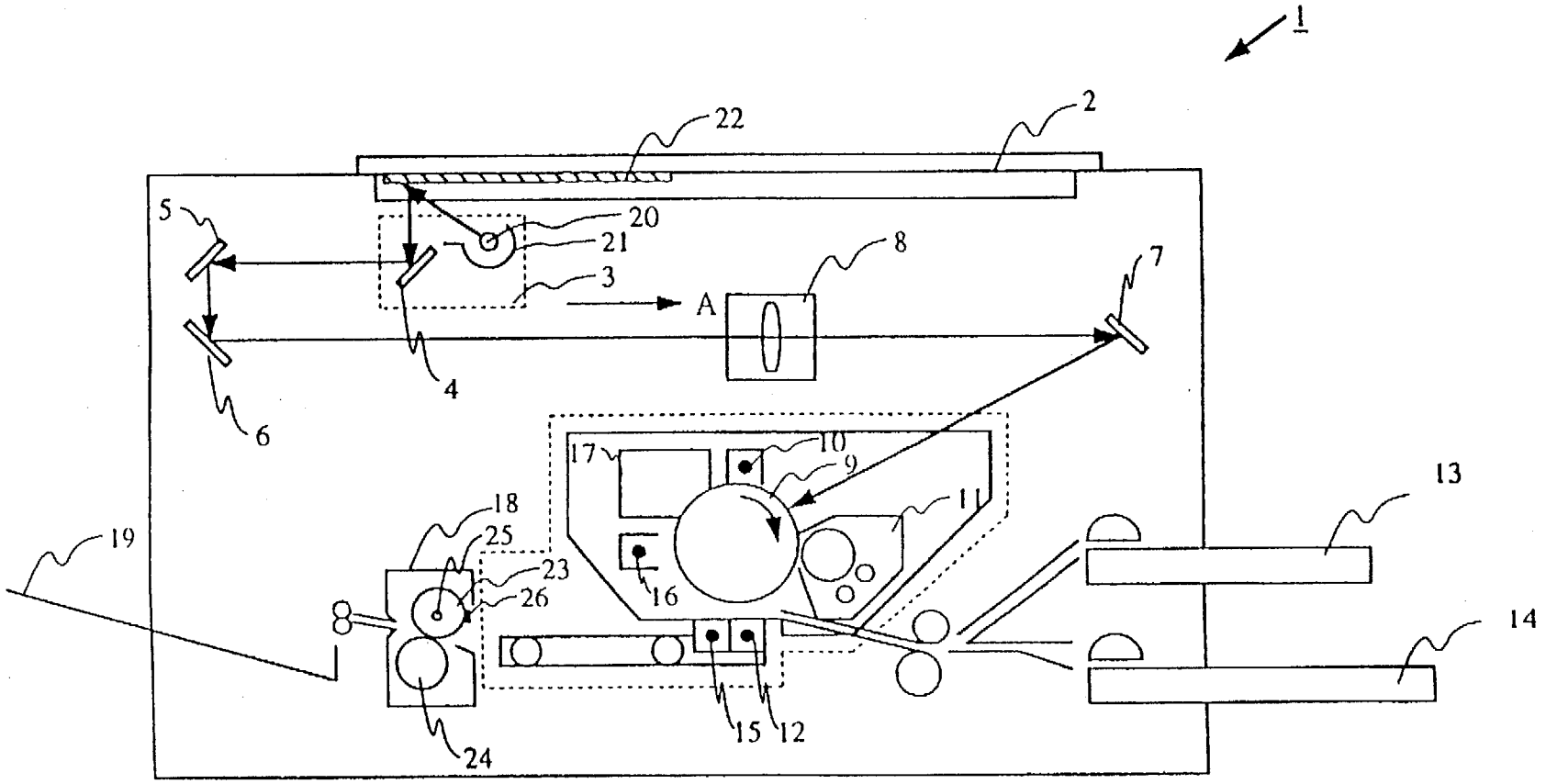
FIG. 1 is a cross sectional view illustrative of a copying machine according to an embodiment of the present invention.

Now referring to the drawings, preferred embodiments of the invention are described below.

The image formation apparatus of the present invention stores image formation history information on the number of past image formation processes, etc. The use frequency is calculated based on this image formation history information, and the temperature of the thermal fixing device on standby is controlled based on the calculated use frequency. Accordingly, the temperature of the thermal fixing device on standby can be controlled based on the use frequency of the image-forming apparatus without lowering the availability factor, while efficiently reducing the power consumption during standby.

In addition, the temperature of the thermal fixing device on standby may be reduced by a prescribed temperature with the lapse of standby time. Here, the value of the prescribed temperature is set to a small value for frequently used image-forming apparatuses, and to a large value for infrequently used image-forming apparatuses, and this allows frequently used image-forming apparatuses to have short waiting times until the image-forming process begins even after long standby times, and allows infrequently used image-forming apparatuses to have greatly reduced power consumption even for short standby times.

In addition, a high target temperature is calculated for a thermal fixing device used in a frequent-use copying machine, and a low target temperature is calculated for one used in an infrequently used copying machine, and the temperature is controlled to the calculated temperatures. This allows a frequently used image-forming apparatus to have a short waiting time due to the high temperature of the thermal fixing device on standby, and allows an infrequently used image-forming apparatus to have greatly reduced power consumption due to the low temperature of the thermal fixing device on standby.

In addition, the temperature of the thermal fixing device is maintained at an image-formable temperature for a long period when used in a frequently used image-forming apparatus, whereas for a short period when used in an infrequently used image-forming apparatus. Accordingly, with a frequently used image-forming apparatus, the waiting time is short even after a long standby time, and the availability factor is not lowered. In contrast, the power consumption is greatly reduced even for a short waiting time in the case of an infrequently used image-forming apparatus.

Furthermore, the image formation history information is classified to determine whether the number of image-formed sheets per process is larger or smaller than a prescribed number, and the temperature of the thermal fixing device on standby is controlled based on the determination.

Accordingly, in an image-forming apparatus used frequently for high-volume processes, but infrequently for low-volume processes (an image-forming apparatus which has a relatively low use frequency, but is continuously used for some periods of time once the image-forming process begins), the thermal fixing device may be set to the calculated high temperature to shorten the waiting time until the image-forming process begins, without lowering the availability factor, along with greatly reduced power consumption.

In contrast, in an image-forming apparatus used infrequently for high-volume processes, but frequently for low-volume processes (for example, an office image-forming apparatus used infrequently for high-volume processes, but frequently for low-volume processes), the thermal fixing device on standby may be controlled to the temperature which is determined based on the pattern of the use frequency of the image-forming apparatus to prevent a lower availability factor, and also to greatly reduce the power consumption.

In addition, in an image-forming apparatus frequently used for both high-volume and low-volume processes (for example, an image-forming apparatus used in a copying center, etc.), the thermal fixing device on standby may be set to the calculated high temperature to shorten the waiting time without lowering the availability factor of the image-forming apparatus.

Also, the image formation history information is collected to sum the number of copies on a prescribed-period basis which is determined by time periods, etc., and the temperature of the thermal fixing device on standby is controlled based on the result of the image formation history information for the given period.

Here, assuming that the prescribed period is on an hourly basis, since office copying machines, for example, are infrequently used during intermissions, etc., the power consumption during such time periods may be efficiently reduced, whereas the availability factors thereof are not lowered, because usually the temperatures are not controlled based on the information obtained during intermissions, etc. during which the use frequencies are extremely low.

In addition, in cases where the prescribed period is on a daily basis, the power consumption of office copying machines, etc., for example, may be more efficiently reduced on holidays, whereas the availability factors thereof are not lowered, because on weekdays the temperatures are not controlled based on the information obtained on holidays during which the use frequencies are extremely low.

As described above, since the temperature of the thermal fixing device may be controlled based on the use pattern of the image-forming apparatus housing it, the waiting time is shorter, the copying process begins immediately, and the availability factor is not lowered in cases where the image-forming apparatus is frequently used. In contrast, in cases where the thermal fixing device is mounted in an infrequently used image-forming apparatus, the power consumption during standby may be efficiently reduced.

In addition, since the use frequencies are summed periodically on an hourly basis, etc., to control the temperature of the thermal fixing device based on the use frequencies related with the given time period, the power consumption is more greatly reduced during intermissions, etc. which have extremely low use frequencies, whereas the availability factor is not lowered, because usually the thermal fixing device is not controlled based on the use frequencies observed during intermissions.

FIG. 1 is a cross sectional view illustrative of the interior of a copying machine which is an embodiment of the present invention. The copying machine 1 comprises an optical system for scanning an original 22 placed on a document table 2; an image-forming section for transferring an original image to a sheet; a sheet feed section for loading stock paper; a fixing section for fixing the toner image transferred to the sheet; and a finished sheet outlet section for discharging the sheet to which the original image has been transferred. The optical system contains an exposure section 3 equipped with a copying lamp 20, a reflector 21 and a mirror 4; and mirrors 5, 6, 7 and a lens 8 for guiding light reflected from the original to the image-forming section. The image-forming section contains a photoconductive drum 9 which rotates clockwise, and its peripheral main charger 10, a developing unit 11, a transfer charger 12, a peel charger 15, a destaticizing charger 16 and a cleaner 17 which are arranged in that order. Sheet cassettes 13, 14 holding stock paper are loaded in the sheet feed section. The fixing section contains a fixing device 18 comprising an upper heat roller 23, a lower heat roller 24, a fixing heater 25 and a thermistor 26. The finished sheet outlet section contains a finished sheet tray 19.

Figure 2:
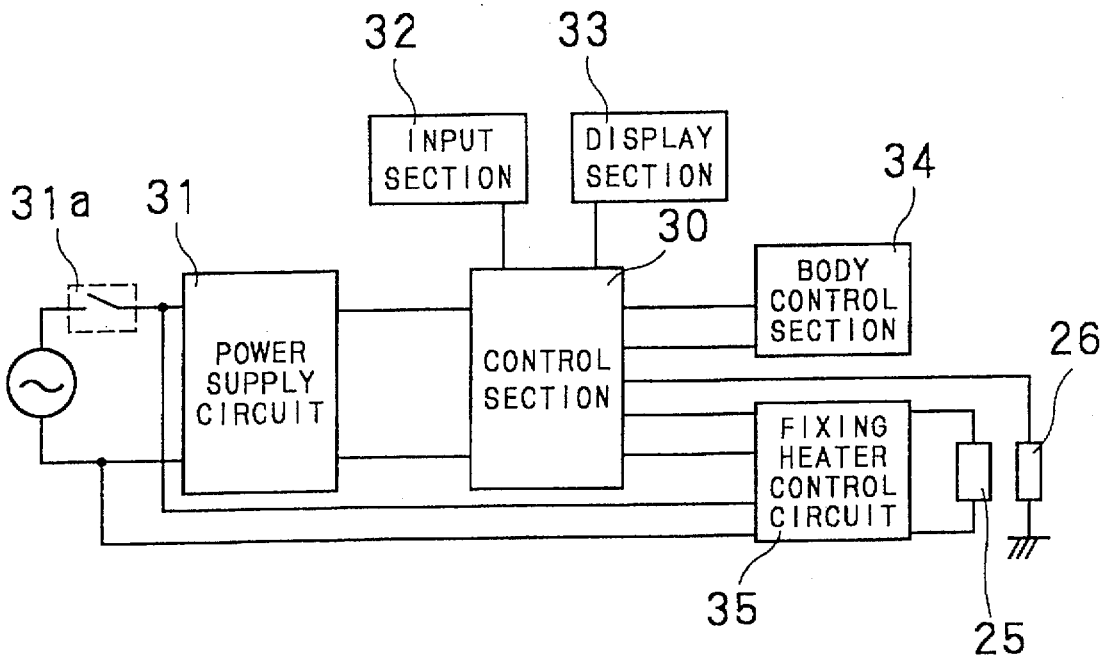
FIG. 2 is a block diagram illustrative of the configuration of the copying machine of FIG. 1.
Figure 3:
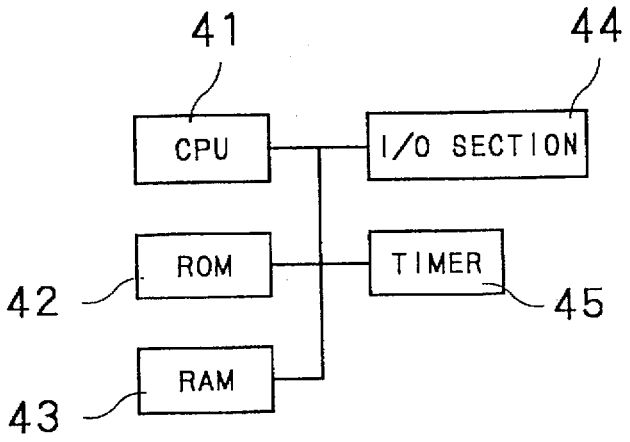
FIG. 3 is a block diagram illustrative of the configuration of the control section of the copying machine of FIG. 1.

FIG. 2 is a block diagram illustrative of the copying machine, and FIG. 3 is a block diagram illustrative of the control section. Connected to the control section 30 are a power supply circuit 31 for receiving commercial power; an input section 32 and a display section 33 provided on an operation panel; a body control section 34 for controlling the operation of the body of the copying machine; a fixing heater control section 35 for controlling a current passing through the fixing heater 25; and a thermistor 26. The control section 30 contains a CPU 41, a ROM 42, a RAM 43, an I/O section 44 and a timer 45, and the ROM 42, the RAM 43, the I/O section 44 and the timer 45 are connected to the CPU 41, respectively. A main switch 31*a* for the copying machine is placed in the power supply circuit 31 to turn on and off the commercial power. In addition, the input section 32, the display section 33, the body control section 26, the fixing heater control section 35 and the thermistor 26 are connected to the I/O section 44.

The copying machine 1 begins the copying process upon operation of the print key (not shown) of the input section 32. When the copying process starts, the copying lamp 20 illuminates, and the exposure section 3 begins scanning the original 22 placed on the document table 2 while moving in the direction A as indicated in FIG. 1. The light reflected from the original 22 arrives at the photoconductive drum 9 via the mirrors 4, 5, 6, 7, and the lens 8. The photoconductive drum 9 is charged by the main charger 10, and reproduces the original image as an electrostatic latent image by receiving the light reflected from the original 22. The developing unit 11 makes this electrostatic latent image visible as a loner image which is then transferred to a sheet supplied from the sheet cassette 13 or 14 loaded in the sheet feed section by the transfer charger 12. The toner image-transferred sheet is peeled from the photoconductive drum 9 by the peel charger 15, and sent to the fixing device 18. The photoconductive drum 9 is destaticized by the destaticizing charger 16, and is then charged again by the main charger 10 after removal of the toner left on the surface by the cleaner 17. The fixing device 18 is designed so that the toner image on the sheet is thermally fixed between the upper heat roller 23 and the lower heat roller 24, and the finished sheet is then transferred onto the finished sheet tray 19. The RAM 43 stacks and stores use frequency data (referred to as "image formation history information" elsewhere throughout the specification) which indicates the use pattern of the copying machine, including the copying process periods, the number of copies during the respective periods, etc. The temperature of the fixing device 18 is controlled based on the use frequency data. The control of the temperature of the fixing device 18 will now be explained in more detail.

Figure 4:
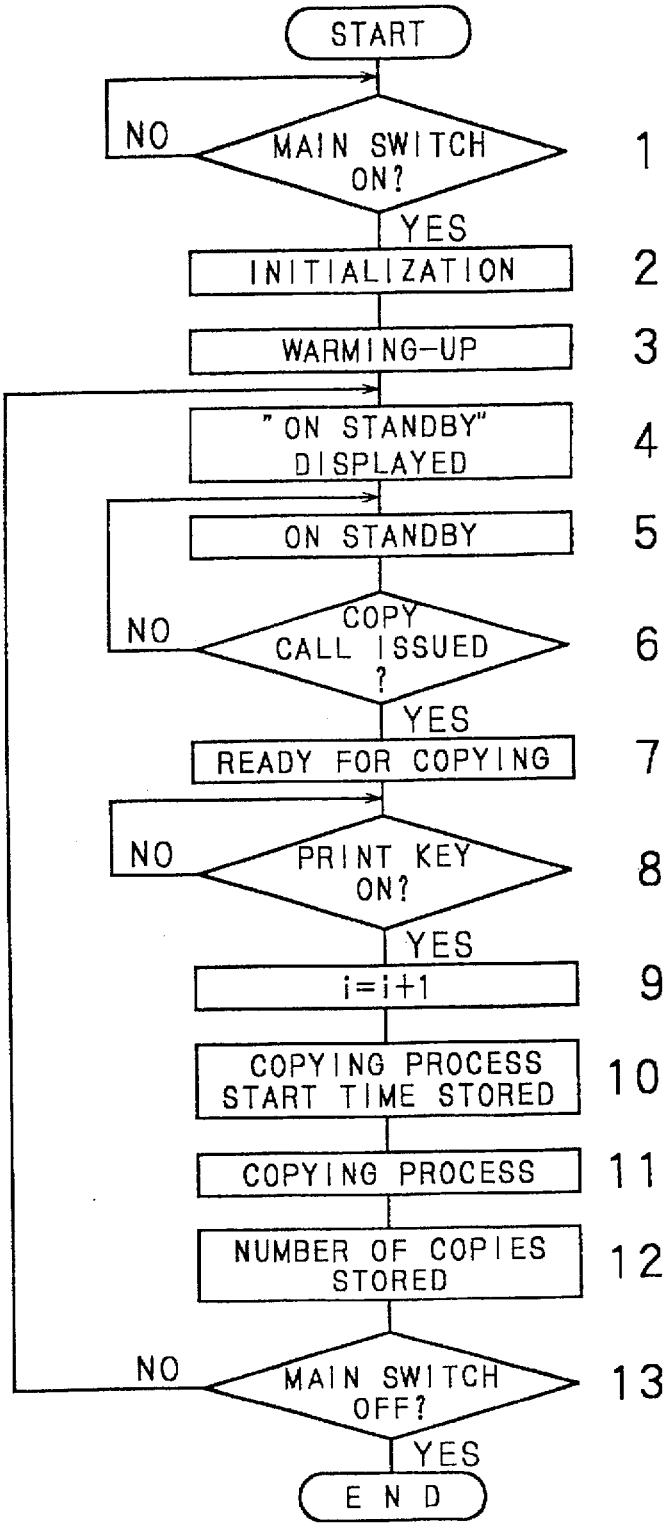
FIG. 4 is a flow chart illustrative of the operation of the copying machine of FIG. 1.

FIG. 4 is a flow chart illustrative of the operation of a copying machine which is an embodiment of the present invention. Throughout the specification, numbers inside parentheses are identical to the numbers of the steps indicated in the respective flow charts. When the main switch 31*a* is activated (1), the copying machine 1 is initialized (2) and warmed up to increase the temperature of the fixing device 18, and to execute other operations (3). Upon completion of the warming-up, the display section 33 displays "on standby", and the copying machine enters into standby state (4, 5). The process during standby (5) will be described below.

The copying machine 1 on standby judges, as a copy call, operation with keys for inputting copying conditions such as the copy scaling factor or operation with the print key which initiates the copying process (6), and comes out of standby state to make preparations for copying (7). These preparations for copying include a process to increase the temperature of the fixing device 18 to a copyable temperature, etc. Upon completion of the preparations for copying, the display section 33 displays "copyable" (8), and then the copying process starts when the print key is operated. To execute the copying process, the variable "i" is first incremented (9), the current date, day of the week and time read out from the timer 45 are then stored in prescribed areas (Di, Wi, ti) (10), and the copying process is executed (11). After completion of the copying process, the number of copies is stored in a prescribed area (Mi) in the RAM 43 (12). The process returns to (4) to restore the copying machine to standby state. The process is stopped when the main switch 31*a* is turned off (13).

Upon finishing the process mentioned above, the RAM 43 stores the history of copying processes (see FIG. 5). "i" denotes the number of copying processes, Mi denotes the number of copies, ti denotes the copying process starting times, Di denotes the date, and Wi denotes the day of the week. The paper sizes, the jam history, etc. may also be stored. The process during standby in (4) will now be explained in more detail. The copying machine selects standby mode as the initial mode. Selection of mode is carried out by the following process, on the basis of the use frequency data which is obtained through calculation by a CPU 41 upon reference to the copying history stored in the RAM 43. According to the present embodiment, the modes include the following modes 1–6. The temperature indicated in each of the modes is the temperature of the fixing device 18 which is detected by the thermistor 26.

Mode 1: The 180° ready temperature (the temperature which allows immediate start of a copying process) is maintained at all times.

Mode 2: The 180° ready temperature is maintained for 8 minutes after a copying process is completed;

the temperature begins to be decreased by 5° per min. 8 minutes after completion of the copying process; and the heat lamp 25 is turned off 16 minutes after completion of the copying process.

Mode 3: The 180° ready temperature is maintained for 4 minutes after a copying process is completed;

the temperature begins to be decreased by 10° per min. until it reaches 120° which is then maintained; and the heat lamp 25 is turned off 16 minutes after completion of the copying process.

Mode 4: The 180° ready temperature is maintained for 2 minutes after a copying process is completed;

the temperature is decreased to 160° 2 minutes after completion of the copying process;

the temperature is then decreased by 20° per min. until it reaches 120° which is then maintained; and the heat lamp 25 is turned off 16 minutes after completion of the copying process.

Mode 5: The 180° ready temperature is maintained for 2 minutes after a copying process is completed;

the temperature is decreased to 120°2 minutes after completion of the copying process; and the heat lamp 25 is turned off 16 minutes after completion of the copying process.

Mode 6: The heat lamp 25 is turned off immediately after a copying process is completed.

Figure 6:
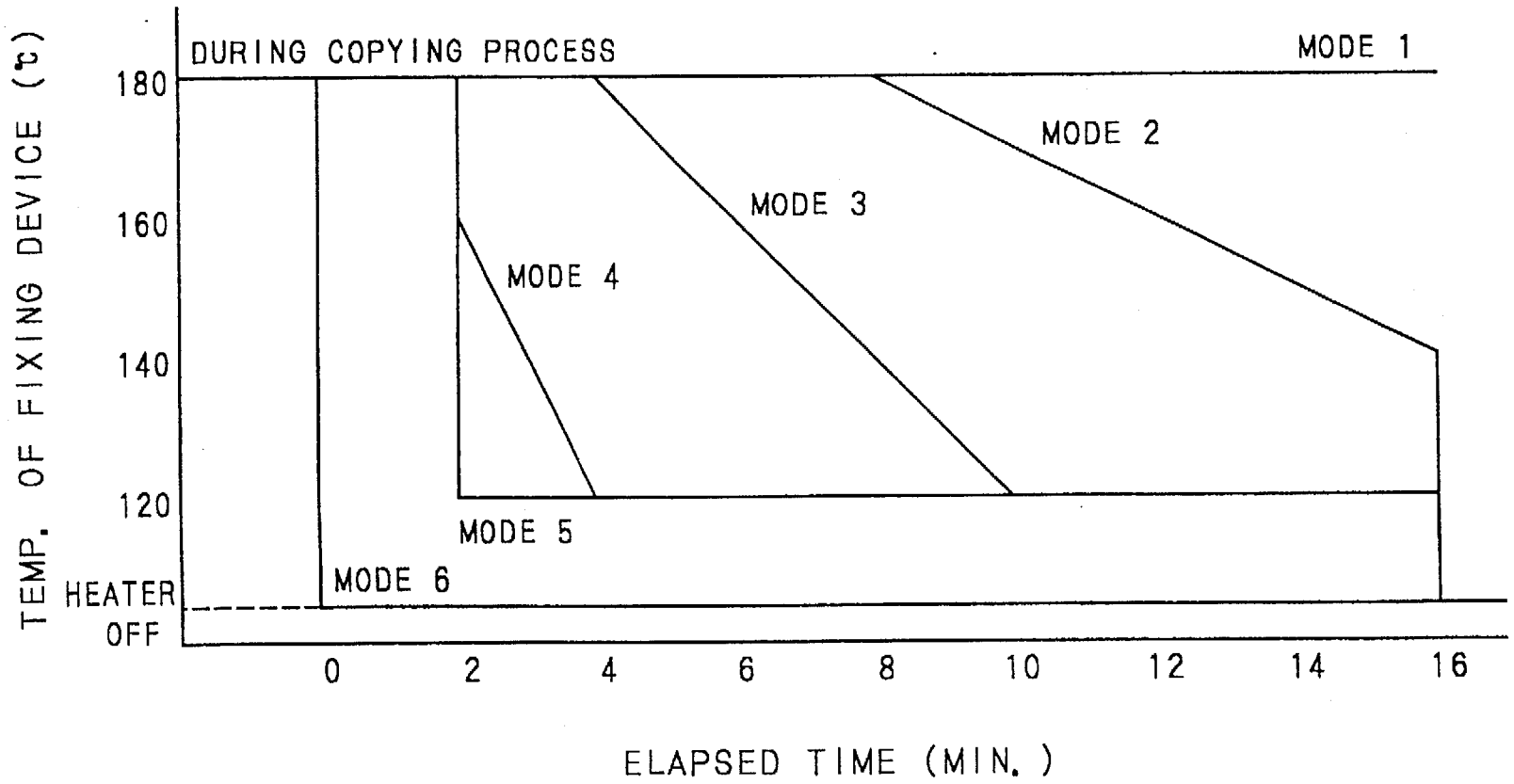
FIG. 6 is a view illustrative of the temperature of a thermal fixing device.
Figure 7:
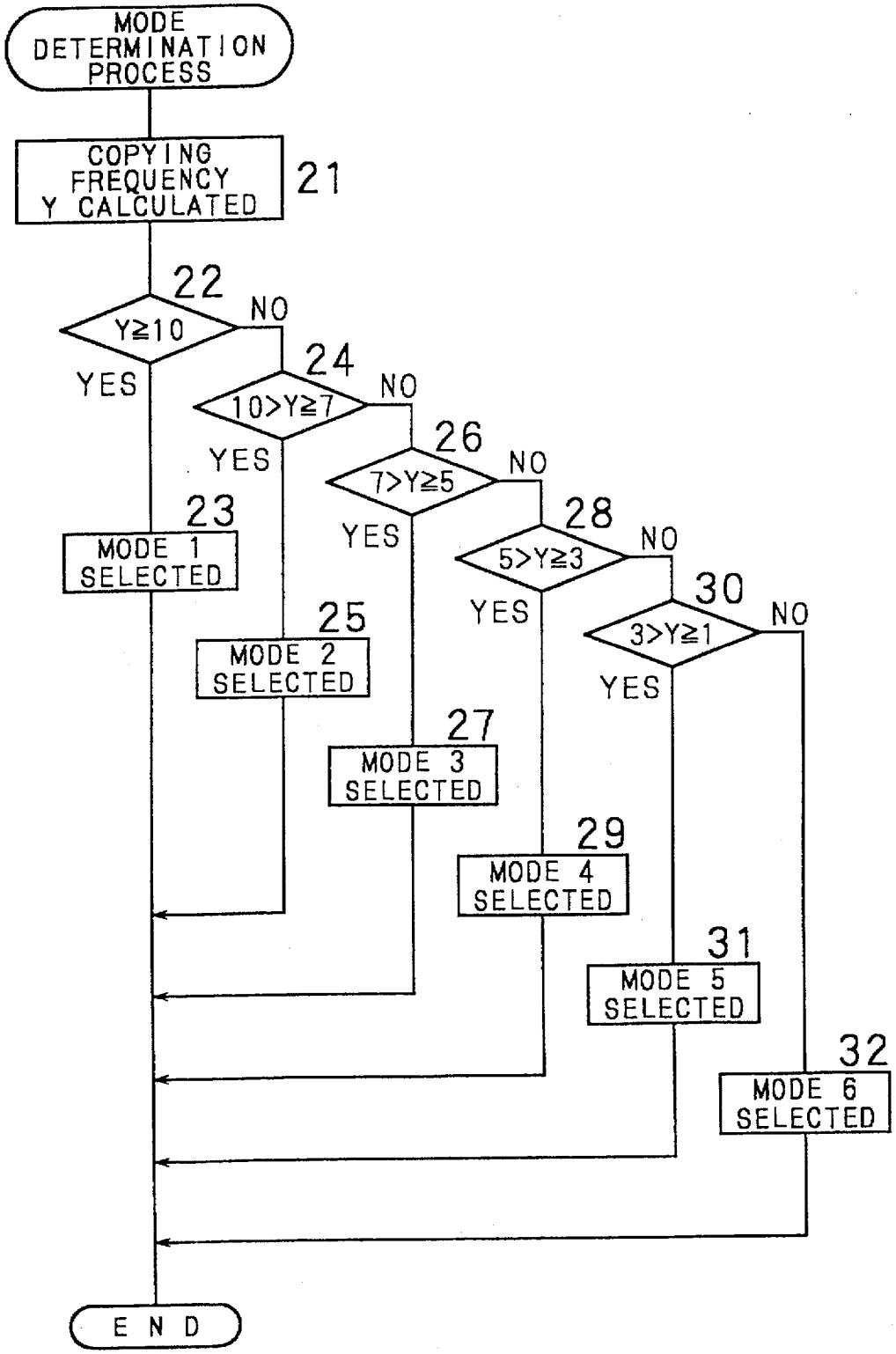
FIG. 7 is a flow chart illustrative of a process of selecting mode.

The changes in the temperature of the fixing device 18 during standby in mode 1 through mode 6 above is shown in FIG. 6. FIG. 7 is a flow chart illustrative of how the mode is determined. First, the copying frequency per unit time is calculated (21). The copying frequency Y is calculated by Y=M/X (M: number of copying processes in a sampling time, X: sampling time). The sampling time X may be, for example, 1) one hour from 9:00 to 10:00 on Jan. 23, 1995;

2) nine hours from 9:00 to 18:00 on Jan. 23, 1995; or 3) one month from 0:00 on Jan. 1, 1995 to 0:00 on Feb. 1, 1995.

Depending on the calculated copying frequency Y, mode 1 is selected for $Y \geqq 10$;

mode 2 is selected for $10 > Y \geqq 7$;

mode 3 is selected for $7 > Y \geqq 5$;

mode 4 is selected for $5 > Y \geqq 3$;

mode 5 is selected for $3 > Y \geqq 1$; and mode 6 is selected for $Y \leqq 1$ (22–32).

The selected mode is set as the mode during standby, and the temperature of the fixing device 18 is controlled in the mode.

Figure 8:
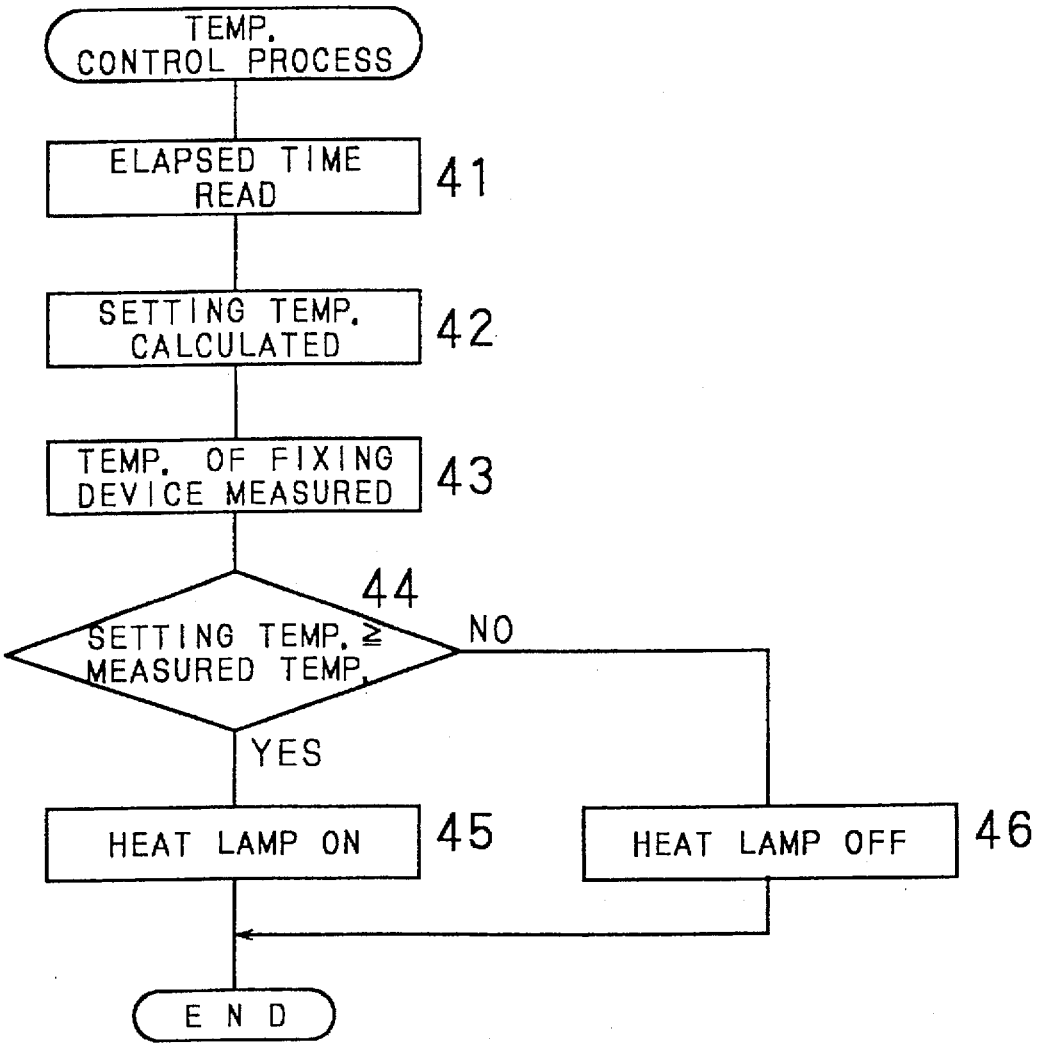
FIG. 8 is a flow chart illustrative of a process of controlling the temperature of a thermal fixing device.

The process of controlling the temperature of the fixing device 18 will now be explained in more detail. FIG. 8 is a flow chart illustrative of the process of controlling the temperature of the fixing device 18. When the mode is selected (21–32), the time elapsed after completion of the copying process (standby time) is read (41). This elapsed time is counted by the timer 45. The temperature T to which the fixing device 18 is to be set is calculated based on the selected mode and the elapsed time (42). For example, in cases where mode 2 is selected, and ten minutes has elapsed since completion of the copying process, the temperature is calculated as T=180–(10–8)*5=170 (degrees). The current temperature of the fixing device 18 is measured by the thermistor 26 (43), and a comparison is made between the setting temperature T calculated, and the measured current temperature (44). In cases where the comparison reveals that the current temperature of the fixing device 18 is higher than the setting temperature T calculated, the fixing heater 25 is turned off (46); conversely, the fixing heater 25 is turned on in the opposite case (45). This process of controlling the temperature is performed repeatedly until the next copy call is issued. The temperature of the fixing device 18 is varied in this way, as shown in FIG. 6. Here, in cases where the copying machine 1 has a high use frequency, a mode for high use frequencies (mode 1 or 2) is selected due to an increased number of operations with the print key, whereas a mode for low use frequencies (mode 5 or 6) is selected in cases where the copying machine 1 is an infrequently used type with a decreased number of operations with the print key. Accordingly, the copying machine 1 has a short waiting time, that is, the interval between the issue of a copy call and the start of copying is short when a mode for high use frequencies is selected, and as the use frequency decreases, power consumption of the fixing heater 25 during standby is reduced, though the waiting time increases. In summary, the copying machine 1 does not suffer from a lower availability factor when it has a high use frequency, and the power consumption of the copying machine 1 during standby is efficiently reduced when it has a low use frequency. FIG. 9 provides data on the temperature, the waiting time after a copy call at the particular temperature and the power consumption of the fixing device 18. For example, with the copying machine 1 set in mode 1 (frequently used copying machine 1), the waiting time is zero, since the temperature of the fixing device 18 is maintained at 180°, and thus the copying process begins at once even after a long standby time, without lowering the availability factor. In contrast, with the copying machine 1 set in mode 6 (infrequently used copying machine 1), the waiting time after a copy call is as long as 40 seconds, since the heater is kept off, whereas the power consumption is greatly reduced even for a short standby time due to zero power consumption during standby. As described above, the fixing apparatus 1 on standby is controlled efficiently depending on its use pattern; the availability factor is not lowered in cases where it has a high use frequency, whereas the power consumption is efficiently and greatly reduced when used infrequently.

Another method of selecting the mode will now be explained. According to the foregoing embodiment, the mode is selected based on the number of copying processes per unit time. An explanation will now be given regarding another embodiment wherein the distribution of numbers of copies prepared by one copying process is considered as well for selection of mode. Here, the following three modes are included in addition to modes 1–6 described above.

1) Copying center mode for copying machines used frequently both for making a small number of copies (low-volume process), and for making a large number of copies (high-volume process);

2) circle mode for copying machines used infrequently for making a small number of copies (low-volume process), and frequently for making a large number of copies (high-volume process); and 3) office mode for copying machines used frequently for making a small number of copies (low-volume process), and infrequently for making a large number of copies (high-volume process).

Figure 10:
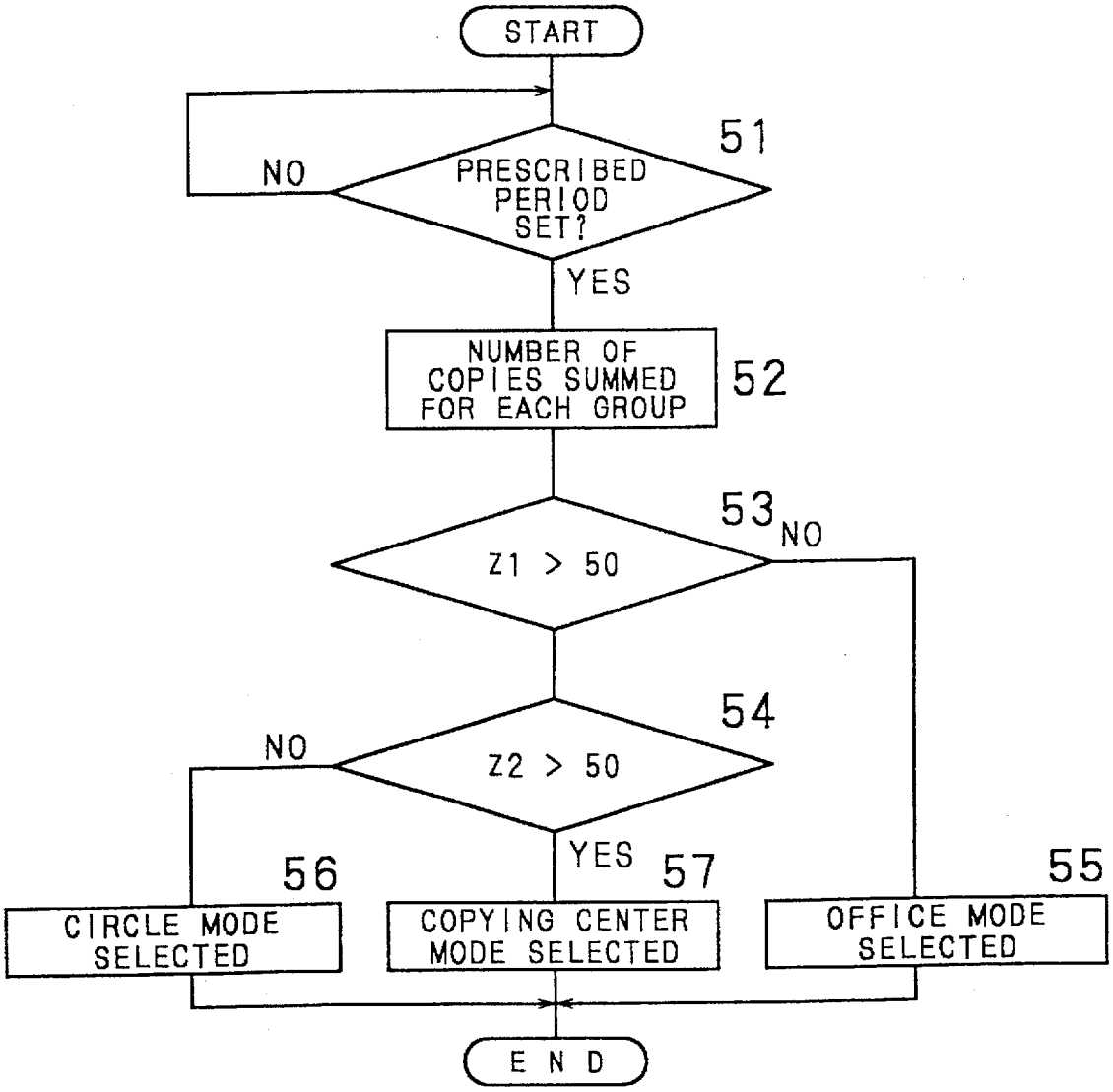
FIG. 10 is a flow chart illustrative of a process of selecting mode according to another embodiment.

FIG. 10 illustrates a flow chart for a process of selecting the modes explained above. First, the prescribed period is set to one week (51). Upon setting the prescribed period, the CPU 41 refers to the copying history to calculate the number of copying processes for each group based on the numbers of copies. In the example illustrated in FIG. 10, calculations are made of the number z1 of copying processes for 11 or more copies (high-volume processes), and the number z2 of copying processes for less than 11 copies (low-volume processes). Copying center mode, circle mode or office mode is selected based on the number of low-volume processes and the number of high-volume processes (53–57). In the illustrated example, 1) Copying center mode is selected in cases where both the number of high-volume processes and the number of low-volume processes are 50 or greater;
2) circle mode is selected in cases where the number of high-volume processes is 50 or greater, and the number of low-volume processes is less than 50; and
3) office mode is selected in cases where the number of high-volume processes is less than 50, and the number of low-volume processes is 50 or greater.

In cases where copying center mode is selected, the selection is unconditionally switched to mode 1 described above; in cases where office mode is selected, the selection is switched to any of modes 1–6 based on the number of copying processes per unit time which is calculated in the same manner as above; and in cases where circle mode is selected, the selection is switched to mode 2 when the number of copying processes per unit time is 3 or more, and to mode 5 when it is less than three.

Since the mode during standby is set in this way, when set to office mode, the waiting time until the copying process begins is short even after a long standby time as long as the use frequency is high, and the power consumption is greatly reduced even for a short standby time as long as the use frequency is low. Furthermore, in the copying center mode, the availability factor of the copying machine is not lowered, since the waiting time is zero at all times. In the circle mode, the mode is shifted to a higher mode for more frequent use to shorten the waiting time, whereas the mode is shifted to a lower mode for lesser frequent use to greatly reduce the power consumption. Accordingly, the temperature of the thermal fixing device 18 may be controlled more precisely, based on the use pattern of the copying machine.

Figures 11A, 11B, 11C:
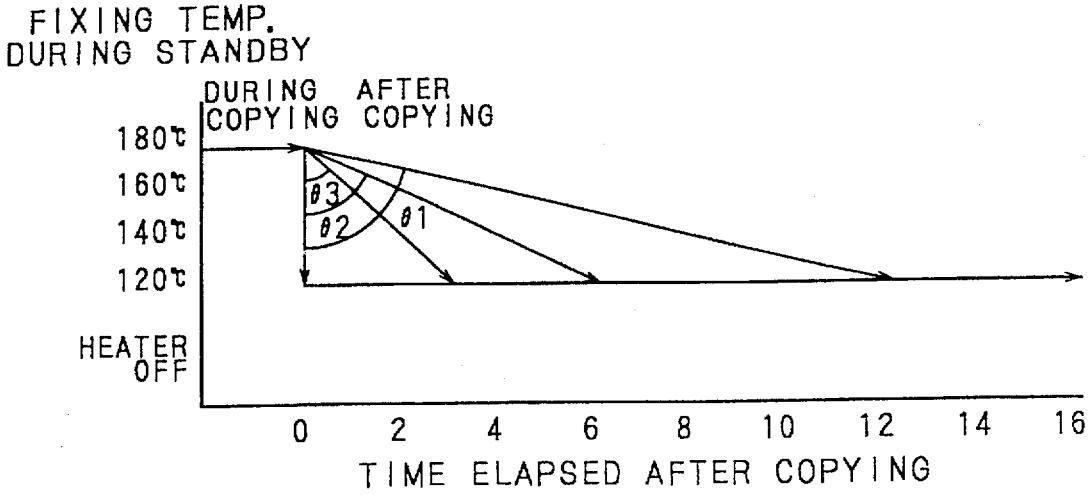
FIGS. 11A to 11C are view illustrative of changes in the temperature of a thermal fixing device according to another embodiment.

Although the temperature of the thermal fixing device 18 is set to be varied with lapse of standby time according to the foregoing embodiment, as illustrated in FIG. 6, the design may be such that the setting temperature during standby decreases by a prescribed temperature with lapse of standby time. Here, the mode is selected from three modes of mode 1 through mode 3. More specifically, the temperature of the thermal fixing device 18 is lowered by five degrees per minute in mode 1, ten degrees per minute in mode 2, or twenty degrees per minute in mode 3. In addition, the use frequency Y per unit time is calculated, and a selection is made of mode 1 for $Y \geqq 7$, mode 2 for $7 > Y \geqq 5$, and mode 3 for $5 > Y$. The change in the temperature of the thermal fixing device 18 on standby in mode 1 through mode 3 is illustrated in FIG. 11(A), and the use frequency Y for which any one of the modes is selected is illustrated in FIG. 11(B). As demonstrated therein, the design is such that the temperature gradient increases as the use frequency decreases. More specifically, when 2 minutes has elapsed since completion of copying, the temperature of the thermal fixing device 18 reaches 170° in cases where mode 1 has been selected, the temperature of the thermal fixing device 18 reaches 160° in cases where mode 2 has been selected, and the temperature of the thermal fixing device 18 reaches 140° in cases where mode 3 has been selected. The power consumption during 2 minutes after completion of copying and the waiting time for copying in each mode are illustrated in FIG. 11(*c*). For example, in mode 1, the temperature T and the power consumption W of the thermal fixing device 18 when 2 minutes has elapsed since completion of copying process may be calculated as follows:

$T=180-(5*2)=170$ (degrees)

$W=(100+90)/2=95$ (W)

In addition, assuming that the increasing rate of the temperature of the thermal fixing device 18 is 4 degrees/sec., the waiting time until the copying process begins is calculated to be $(180-170)/4=2.5$ (sec.)

As described above, in cases where the use frequency is high, the waiting time may be relatively shortened even after a long standby time, and the power consumption may also be reduced depending on the waiting time. In contrast, the power consumption may be greatly reduced even for a short standby time in cases where the use frequency is low. This results in a shorter waiting time for the copying process, and greatly reduced power consumption for a waiting time. Here, the mode may be selected from modes 1 through 6 and the three modes designed above as copying center mode, etc.

Figures 12A, 12B:
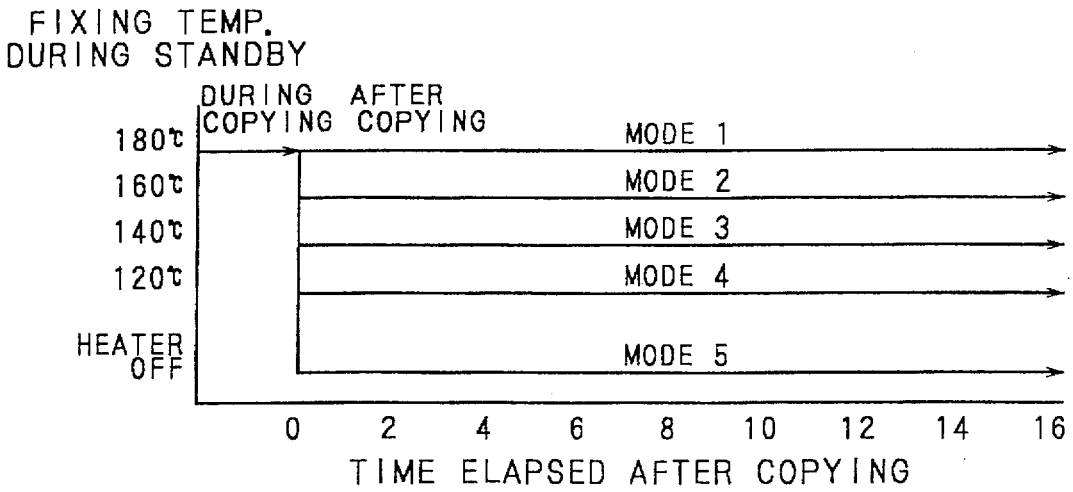
FIGS. 12A and 12B are view illustrative of changes in the temperature of a thermal fixing device according to yet another embodiment.

Furthermore, the temperature during standby may be set independently for each mode. Here, the mode is selected from five modes, mode 1 through mode 5. The temperature is set to 180° for mode 1, 160° for mode 2, 140° for mode 3, and 120° for mode 4, whereas the heater 25 is kept off for mode 5. In addition, as described above, the use frequency Y per unit time is calculated for selection of mode, and mode 1 is selected for $Y \geqq 7$, mode 2 for $7 > Y \geqq 5$, mode 3 for $5 > Y \geqq 3$, mode 4 for $3 > Y \geqq 1$, and mode 5 for $1 > Y$. The change in the temperature of the thermal fixing device 18 on standby in mode 1 through mode 5 is illustrated in FIG. 12(A). As illustrated, the design is such that the setting temperature for standby time decreases as the use frequency decreases. FIG. 12(B) is a table listing the power consumption during standby, and the waiting time for copying process. Since the temperature of the thermal fixing device 18 is controlled as described above, the waiting time for the copying process may be shorter for frequently used image-forming apparatuses, and the power consumption during standby may be greatly reduced with infrequently used image-forming apparatuses.

Figures 13A, 13B:
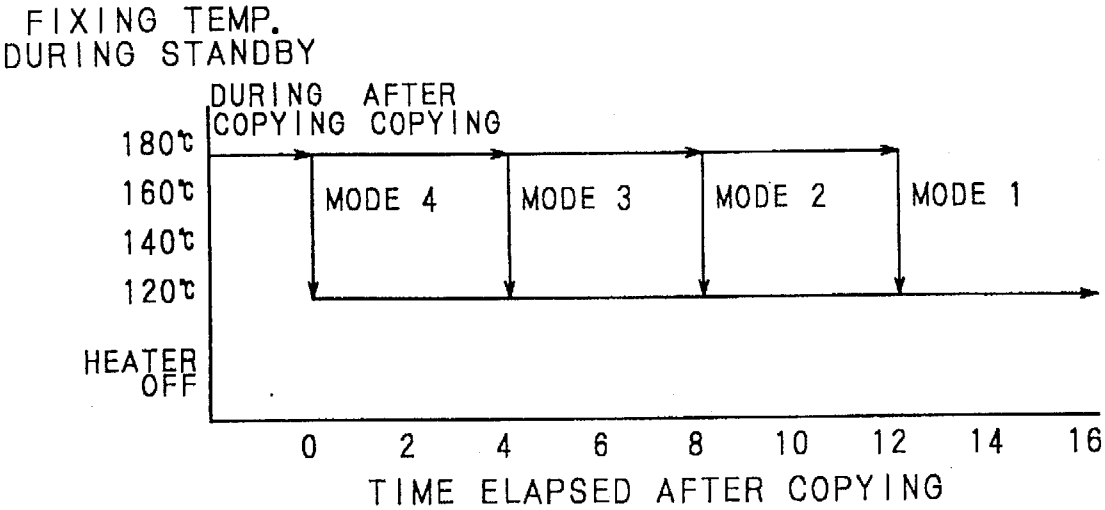
FIGS. 13A and 13B are view illustrative of changes in the temperature of a thermal fixing device according to yet another embodiment.

Furthermore, the period during which the thermal fixing device 18 is maintained at a copyable temperature after completion of the copying process may be set for each mode, and the temperature may be decreased to a prescribed temperature (120° in the illustrated case) at the conclusion of the set period. Here, the mode is selected from four modes, mode 1 through mode 4. The copyable temperature is maintained for 12 minutes in mode 1, for 8 minutes in mode 2, and for 4 minutes in mode 3, whereas the temperature is immediately reduced to 120° in mode 4. Also, as described above, the use frequency Y per unit time is calculated for selection of mode, and mode 1 is selected for $Y \geqq 7$, mode 2 is selected for $7 > Y \geqq 5$, mode 3 is selected for $5 > Y \geqq 3$, and mode 4 is selected for $3 > Y$. FIG. 13(A) illustrates the change in the temperature of the thermal fixing device 18 on standby in mode 1 through mode 4. As illustrated, the copyable temperature-maintaining period is made shortened as the use frequency decreases. FIG. 13(B) is a table listing the power consumption during standby, and the waiting time for the copying process. Since the temperature of the thermal fixing device 18 is controlled in this way, frequently used copying machines tend to have zero waiting times for copying processes, and therefore the availability factors are not lowered. In addition, since the temperature is designed to decrease to the setting temperature for standby (120°) in a short time, the power consumption during standby may be efficiently reduced.

Figures 14A, 14B:
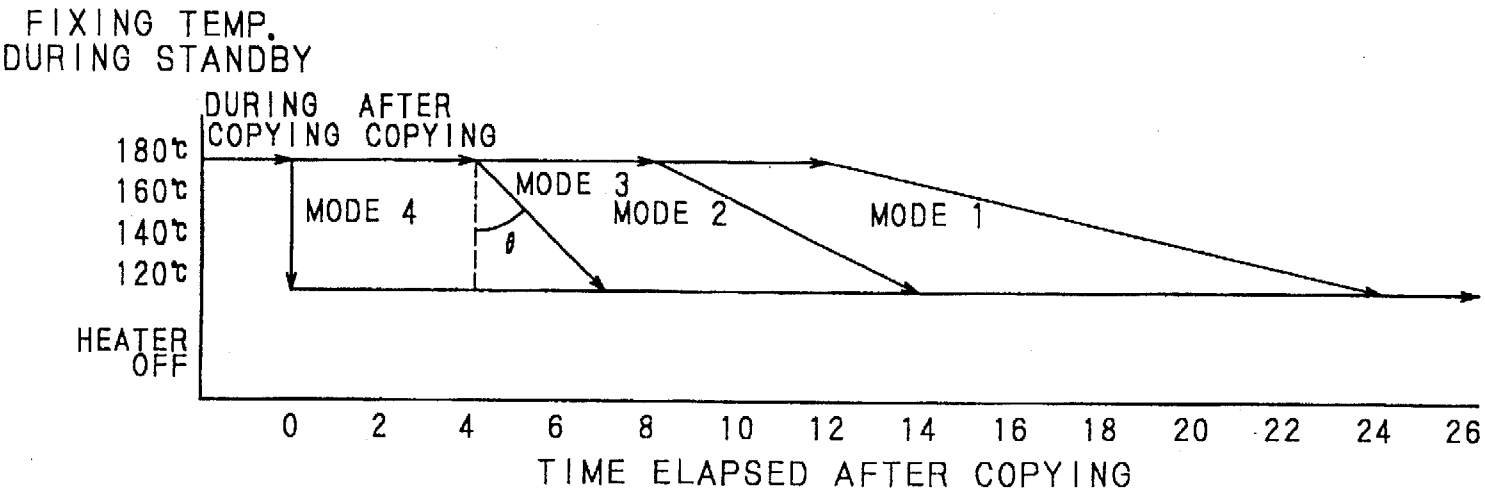
FIGS. 14A and 14B are view illustrative of changes in the temperature of a thermal fixing device according to yet another embodiment.
Figures 15A, 15B:
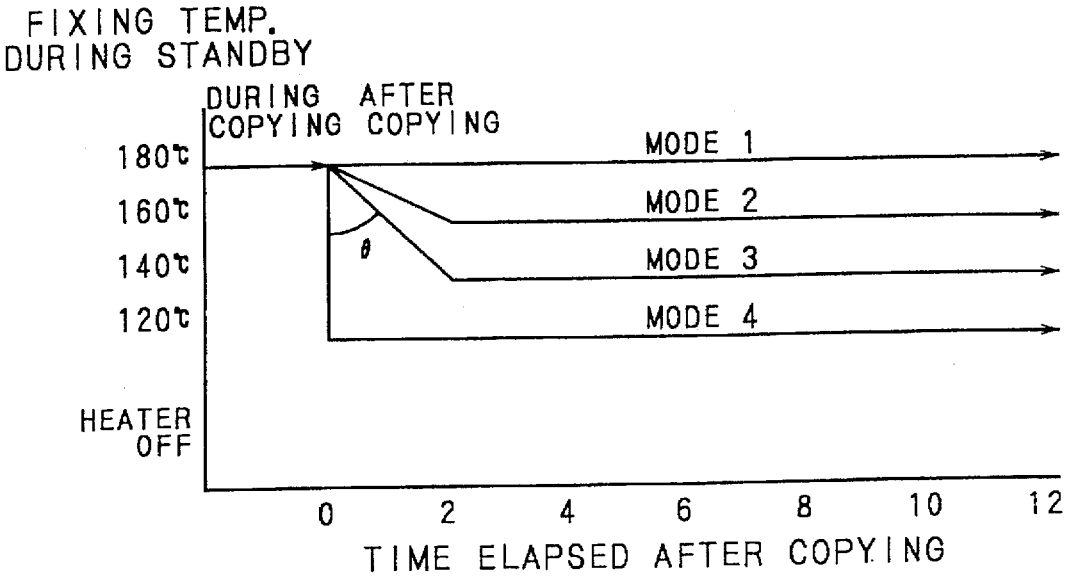
FIGS. 15A and 15B are view illustrative of changes in the temperature of a thermal fixing device according to yet another embodiment.
Figures 16A, 16B:
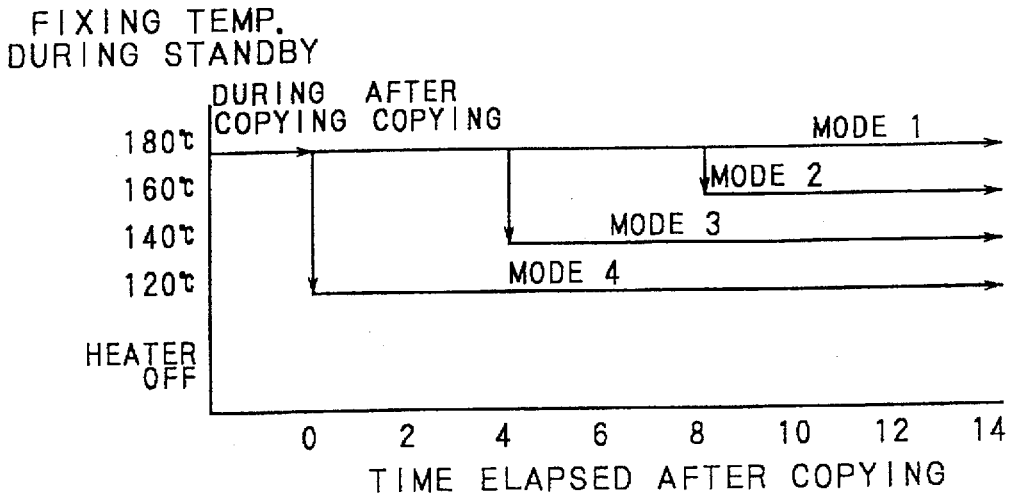
FIGS. 16A and 16B are view illustrative of changes in the temperature of a thermal fixing device according to yet another embodiment.

In addition, the above-described methods of controlling the temperature of the thermal fixing device 18 may be combined to perform the control procedures as illustrated in FIG. 14 through FIG. 16. In these drawings, the (A) sections illustrate the change in the temperature of the thermal fixing device 18, and the (B) sections are tables listing the waiting time for copying, and the power consumption. The control illustrated in FIG. 14 is designed so that the period, during which the thermal fixing device 18 is maintained at a copyable temperature after completion of copying process, is set for each mode, and the temperature begins to be decreased by a prescribed temperature at the conclusion of the set period. With this design, in the case of high-frequency use, the period during which the copyable temperature is maintained is longer, and the temperature gradient after lapse of the period is also moderate, so the waiting time for the copying process is shorter, and the availability factor is not lowered. In contrast, in the case of low-frequency use, the period during which the copyable temperature is maintained is shorter, and the temperature gradient after lapse of the period is also steep, so the power consumption may be greatly reduced even for a short standby time.

The control illustrated in FIG. 15 is for setting a temperature gradient for each mode, and for setting a lower limit temperature during standby. This control results in the waiting time for copying process being zero, and the availability factor is not lowered in mode 1 for high use frequencies, and prevents impairment of the effect of reducing the power consumption during standby in mode 4 for low use frequencies, since the temperature of the thermal fixing device 18 is immediately set to 120°. In addition, even in mode 2 or mode 3 for mid-range use frequencies, the temperature gradients do not cause lower availability factors, and the power consumption during standby may be efficiently reduced.

The control illustrated in FIG. 16 is designed so that the period, during which the thermal fixing device 18 is maintained at a copyable temperature after completion of copying process, is set for each mode, and the temperature is varied to the temperature set for each mode at the conclusion of the period. This design prevents frequently used copying machines from having lower availability factors, and allows infrequently used copying machines to have greatly reduced power consumption during standby.

Also, the copying history may be summed periodically, such as on a hourly, daily, weekly or monthly basis, to set the mode for the copying machine 1 during standby. Assuming that the copying history is summed on a hourly basis, for example, mode 5 or mode 6 may be selected for the copying machine 1 when used in an office, etc. during intermissions with extremely low use frequencies, to efficiently reduce the power consumption. In addition, since the use pattern observed during intermissions, etc. is not considered for the control during ordinary hours, the availability factor of the copying machine is not lowered.

Furthermore, in cases where the copying history is summed on a daily basis in order to set the mode during standby, the status of the copying machine 1 during standby may be set separately for holidays with low use frequencies for the copying machine 1, and for weekdays. The operation during standby may be controlled based on a more detailed use pattern in cases where the copying history is summed both on a daily basis and on a hourly basis.

Figure 17:
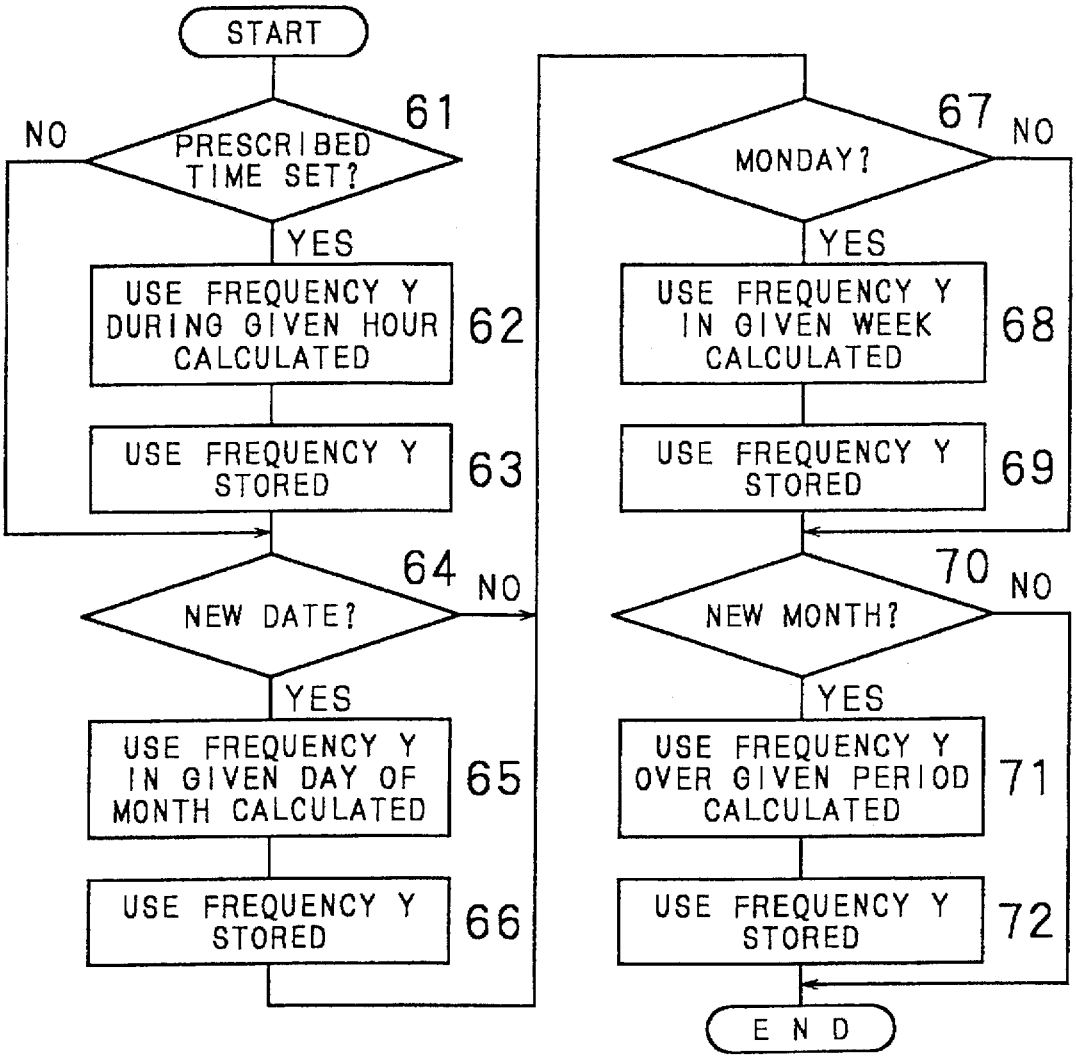
FIG. 17 is a flow chart illustrative of a process of calculating periodic use frequencies.
Figure 18:
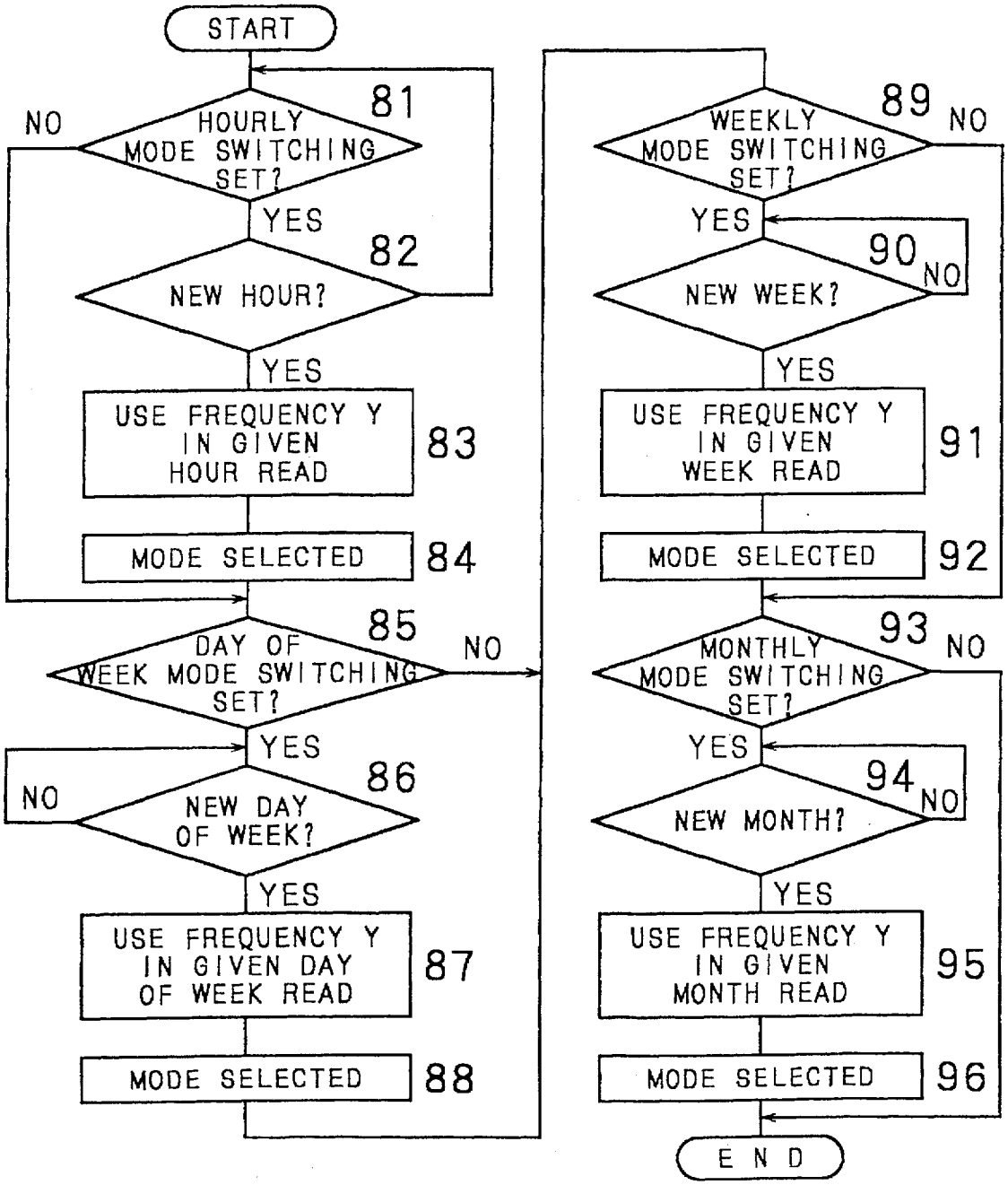
FIG. 18 is a flow chart illustrative of a process of setting the mode periodically.

FIG. 17 is a flow chart illustrative of a process of calculating a periodic use frequency, and FIG. 18 is a flow chart illustrative of a process of periodic (hourly, daily, etc.) switching between the modes. When the current time measured by the timer 45 reaches X: 00 (min.) (a prescribed time), wherein X is 1, 2, . . . , the use frequency Y over that hour is calculated and stored (61–63). In addition, when a new calendar date begins, the use frequency Y in the last day is calculated and stored (64–66). Likewise, when a new week begins (on Monday, for example), the use frequency Y over the last week is calculated on a weekly basis, and the use frequency Y over the last month is calculated on a monthly basis (67–72). The periodic use frequencies calculated in this way are stored in the RAM 43. Then, in cases where hourly switching between the modes has been set (81), when a new hour begins (82), the use frequency Y related to the new hour is read from the RAM 43 (83), and used to select one of the modes according to any of the methods described above (84). The temperature of the thermal fixing device 18 is controlled during the hour in the mode selected as described above (84). Such a mode selection as described above is performed each time a new hour begins.

Likewise, in the case of daily switching between the modes (85), each time a new day starts (86), the use frequency Y related to the new day is read from the RAM 43 (87), and used to select one of the modes according to any of the methods described above (88). Likewise, in the case of weekly switching between the modes (89), each time a new week begins, the use frequency Y related to the new week (designated as the first or the second week of the month, for example), is used to perform a mode selection, and the temperature is controlled in the selected mode (90–92). In addition, in the case of monthly switching between the modes (93), the use frequency Y related to the current month is used to perform a mode selection (94–96). The mode selection may be performed using those periodic switchings in combination.

As described above, since the mode is designed to be renewed periodically such as on a hourly, daily, weekly or monthly basis, the mode for standby time may be flexibly switched (the method for control during standby may be substituted) based on possible changes in the use frequency of the copying machine 1 which may occur early or late in the month and season, and at other points in time. In addition, even hourly changes in the use frequency of the copying machine 1 may be dealt with to prevent lowering in the availability factor of the copying machine 1 and to greatly reduce the power consumption.

The data on the use frequency, though designed to be automatically stored according to the embodiments described above each time a copying process is executed, may be inputted by keying or in some other manner. The mode for standby time may also be forcedly set by keying. Further, the embodiments explained above are mere example of application of the present invention to a copying machine, and the present invention may be applied all image-forming apparatuses equipped with thermal fixing devices, including fax machines. It is also to be noted that the present invention is not limited by the numbers of the modes used according to the embodiment described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image-forming apparatus equipped with a thermal fixing device which fixes a toner image on a sheet, said apparatus comprising:

storage means for storing the image formation history information including the number of image forming processes implemented in the past; and temperature control means for calculating the use frequency based on the image formation history information stored in the storage means to control the temperature of the thermal fixing device on standby based on the calculated use frequency.

2. The image-forming apparatus according to claim 1, wherein the temperature control means comprises means for lowering the temperature of the thermal fixing device by a prescribed temperature with the lapse of standby time and means for determining the prescribed temperature based on the use frequency.

3. The image-forming apparatus according to claim 1, wherein the temperature control means comprises means for controlling the thermal fixing device on standby to a temperature which is set high when the use frequency is high, and low when the use frequency is low through calculation.

4. The image-forming apparatus according to claim 1, wherein the temperature control means comprises means for setting through calculation the time during which the temperature of the thermal fixing device on standby is maintained at an image-formable temperature, to a long time for frequent use and to a short time for infrequent use relative to the lapse of the standby time.

5. The image-forming apparatus according to any of claims 1–4, wherein the temperature control means comprises means for classifying the image formation history information into the frequency of high-volume processes in which the number of image-formed sheets per process is larger than a prescribed number, and the frequency of low-volume process in which the number of image-formed sheets per process is smaller than the prescribed number to calculate the temperature to be set for the thermal fixing device during standby.

6. The image-forming apparatus according to any of claims 1–4, wherein the temperature control means comprises summing means for summing data of the image formation history information on a prescribed period basis, and controls the temperature of the thermal fixing device based on the image formation history information for a given period corresponding to the current period of operation.

7. The image-forming apparatus according to claim 6, wherein the temperature control means comprises means for classifying the image formation history information into the frequency of high-volume processes in which the number of image-formed sheets per process is larger than a prescribed number, and the frequency of low-volume process in which the number of image-formed sheets per process is smaller than the prescribed number to calculate the temperature to be set for the thermal fixing device during standby.

* * * * *